US005463404A

United States Patent [19]

Wall

[11] Patent Number: 5,463,404

[45] Date of Patent: Oct. 31, 1995

[54] TUNED MICROSTRIP ANTENNA AND METHOD FOR TUNING

[75] Inventor: Angela M. Wall, Largo, Fla.

[73] Assignee: E-Systems, Inc., Dallas, Tex.

[21] Appl. No.: 316,646

[22] Filed: Sep. 30, 1994

[51] Int. Cl.[6] ..... H01Q 1/38

[52] U.S. Cl. ..... 343/700 MS; 343/873; 29/600

[58] Field of Search ..... 343/700 MS, 872, 343/873; 29/600; H01Q 13/08, 1/38

[56] References Cited

U.S. PATENT DOCUMENTS

| | | | |
|---|---|---|---|
| 4,089,003 | 5/1978 | Conroy | 343/700 MS |
| 4,218,682 | 8/1980 | Yu | 343/700 MS |
| 5,181,025 | 1/1993 | Ferguson et al. | 343/700 MS |
| 5,400,039 | 3/1995 | Araki et al. | 343/700 MS |

*Primary Examiner*—Donald Hajec
*Assistant Examiner*—Tan Ho
*Attorney, Agent, or Firm*—Harold E. Meier

[57] ABSTRACT

A prefabricated and assembled microstrip antenna element has at least one layer of dielectric substrate on which is deposited a metal etched to form a radiating element and over which is attached a protective radome. To compensate for uncontrollable variations in the dielectric constant of the substrate between different lots of material, the resonance frequency of the assembled microstrip is shifted or tuned to a desired resonance frequency by drilling a bore hole of predetermined diameter and location through the radome, metal layer and substrate that removes a predetermined amount of metal from a predetermined location on the radiating element. The bore hole is then filled with a non-conductive epoxy having a dielectric constant approximately equal to that of the substrate.

15 Claims, 2 Drawing Sheets

TUNED MICROSTRIP ANTENNA AND METHOD FOR TUNING

FIELD OF THE INVENTION

The invention relates to microstrip antennas and, more specifically, to tuning a microstrip antenna element once assembled.

BACKGROUND OF THE INVENTION

A microstrip antenna element is fabricated using conventional printed circuit board manufacturing and photoetching techniques. A dielectric sheet or substrate is clad on one side with a metal, such as copper or a similar conductor. The metal layer is etched to a predetermined pattern to form a radiator or antenna element. The pattern is typically either round or square, depending on the application. The metal on the other side of the dielectric sheet forms a ground plane. Generally, coaxial feed probes are fed from the ground plane side, through the substrate and to metal antenna element for coupling the antenna element to an external circuit. However, line feeds may also be formed on the surface of the dielectric sheet to couple the antenna element to a circuit. Once the metal is etched to form the antenna element, a radome comprised of a dielectric is bonded to the dielectric substrate, over the metal layer. A multi-layer microstrip antenna is constructed by bonding together two or more antenna elements, each typically separated from the other by an additional sheet of dielectric substrate.

The resonant frequency of a microstrip antenna element depends on the thickness of the dielectric substrate and its dielectric constant. Typically, in order to obtain wide hemispheric coverage with a small antenna size, a substrate with a comparatively high dielectric, typically greater than 6, is chosen. Vendors of dielectric substrate material normally control variations in the dielectric constant to about 5%. Current measurement techniques do not have an accuracy sufficient to determine the dielectric constant with significantly greater accuracy. Consequently, uncontrollable variations in the dielectric constant between lots of substrate often result in large shifts in resonance frequency when the same antenna design is fabricated from new lots of substrate. Due to the already narrow bandwidth of the microstrip antennas, shifts in resonant frequency often severely degrade gain and performance of the antenna at desired frequencies. Therefore, a microstrip antenna is typically designed around a single lot of substrate material. Antennas fabricated in subsequent runs with different lots of substrate must sometimes be scrapped even when the dielectric constant is within manufacturer's tolerances for the original lot.

A microstrip antenna element can be tuned by attaching metal stubs to the metal layer forming the antenna element, or by cutting away tuning stubs formed with the metal layer. However, once a microstrip antenna element is assembled with a radome covering or with other microstrip antenna elements as a layer of a multi-layer microstrip antenna, the antenna can no longer be tuned.

SUMMARY OF THE INVENTION

The invention solves the aforementioned problems by providing a method for tuning microstrip antenna elements once assembled with the radome or with other microstrip antenna elements into a single layer or multi-layer microstrip antenna. The invention thus results in microstrip antennas with improved performance and in fewer rejects during fabrication, especially in manufacturing runs using different lots of substrate.

According to one aspect of the invention, an assembled microstrip antenna is tuned to the desired resonance frequency by selecting a predetermined location and bore diameter for drilling a hole through its radome. Drilling through a metal layer forming a antenna element removes the removes a portion of the metal layer that results in shift higher the resonance frequency of the element. The resulting bore hole is then filled with an non-conductive material having a dielectric constant similar to that of the substrate.

According to another aspect of the invention, a bore hole is drilled to, but not through, the metal layer and additional metal is added through the bore hole and bonded to the metal layer to lower the resonance frequency of the element.

According to another aspect of the invention, bore holes are drilled along an inter-cardinal axis of the antenna's radiating pattern to avoid interference with polarization and coupling with other antenna elements.

The forgoing summary is intended to be merely illustrative of the invention. Other aspects and advantages of the invention are disclosed by the following description taken in conjunction with the accompanying drawings.

DESCRIPTION OF THE PREFERRED EMBODIMENT

In the following description, like numbers refer to like parts.

Figure 1:
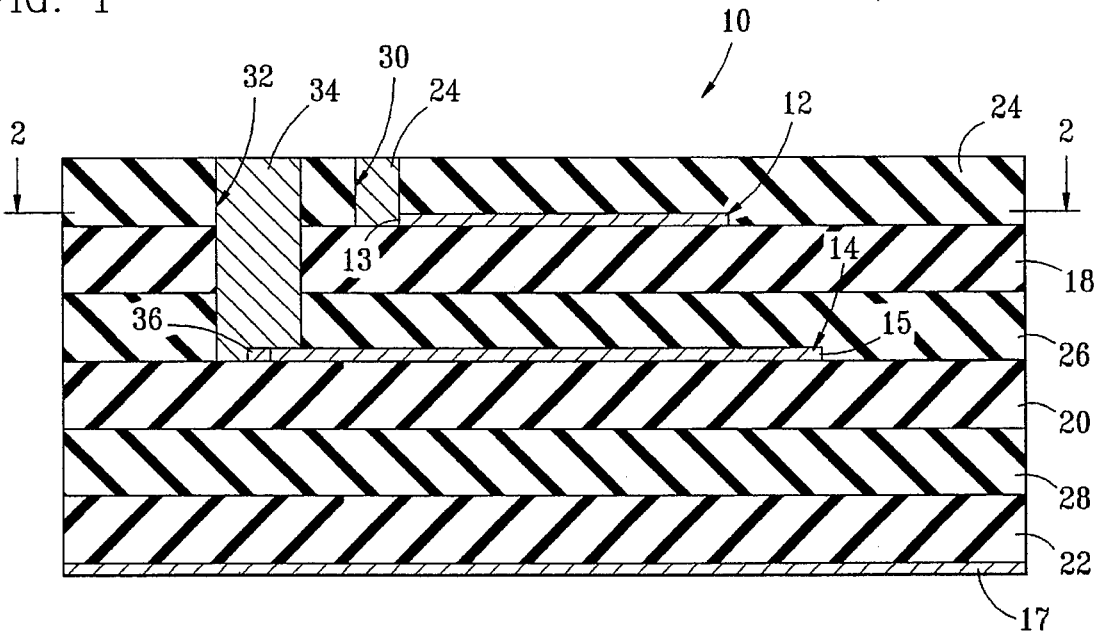
FIG. 1 is a cross-section through a multi-layer microstrip antenna.

Referring to FIG. 1, tuned multi-layer microstrip antenna 10 is comprised of two antenna elements or radiators 12 and 14 and ground plane 16. The antenna elements and ground plane are fabricated in separate processes and then assembled into the multi-layer microstrip antenna. Antenna element 12 is formed using conventional printed circuit board techniques by depositing a layer of metal 13, commonly called "metallization," on a top surface of layer 18 of soft dielectric substrate and etching away portions of the metal to create a predetermined antenna pattern. Radiating element 14 is formed in the same manner by depositing metal layer 15 on top of layer 20 of soft dielectric substrate and etching away metal according to a predetermined antenna pattern. The size, shape and spatial relationship of antenna elements 12 and 14 depend on the desired radiating pattern of the antenna and its application. Ground plane 16 is formed on a bottom surface of layer 22 of soft dielectric substrate by depositing a layer of metal 17 using conventional printed circuit board techniques.

The first and second antenna elements 12 and 14 then are assembled with ground plane 16 to form an assembled, but not yet tuned, microstrip antenna. Dielectric layer 24 is bonded to the top surface of dielectric substrate 18 to form a radome. An intermediate soft dielectric substrate 26 is bonded to the top of radiator surface of dielectric substrate layer 20 layer and to a bottom surface of dielectric substrate layer 18 to separate the first and second antenna elements 12 and 14. Similarly, intermediate soft dielectric substrate layer 28 is bonded to a top surface of layer 22 and a bottom surface of layer 20 to separate the second antenna element from the ground plane 16.

After assembly of the two antenna elements with the ground plane and the radome, the microstrip antenna is tuned by drilling bore holes 30 and 32 from an upper, outside surface of radome layer 24. Bore hole 30 is drilled through the metal layer 13 to remove a portion of the metal. Removing metal from the layer tends to increase the resonance frequency of antenna element 12. Bore hole 32 is drilled to the top of the metal layer 15. Additional metal 36 is added to bore hole 32 and bonded to metal layer 15 using conductive epoxy or a gap welder. This additional metal decreases the resonance frequency of the antenna element 14. Both bore holes are then filled flush with the outer surface of radome layer 24 with a non-conductive epoxy 34 having a dielectric constant similar to that of the layers of soft dielectric substrate.

Figure 2:
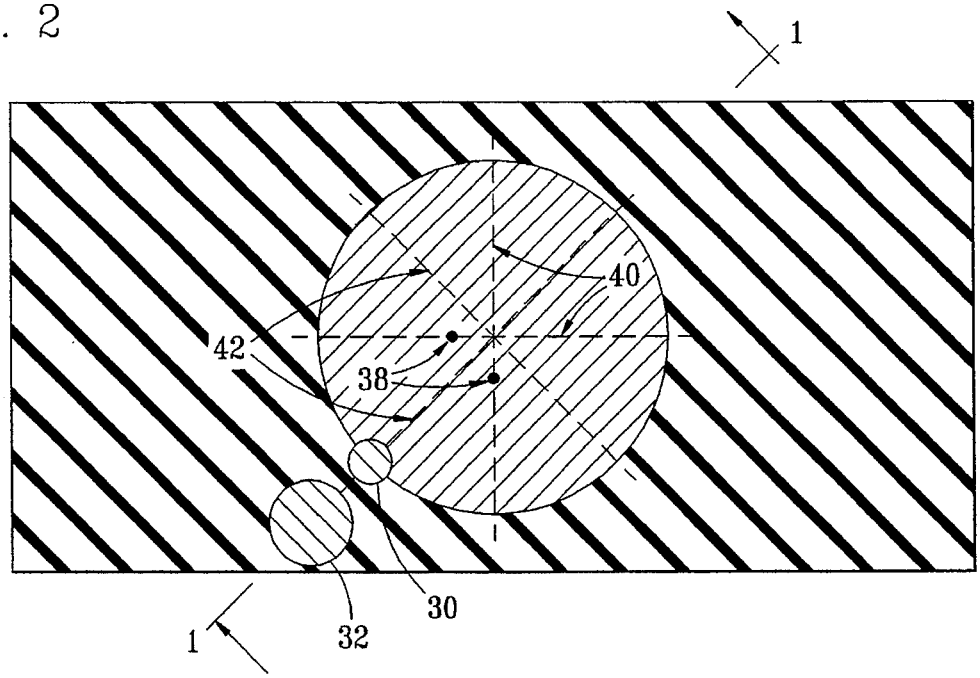
FIG. 2 is a cross-section of a circular radiator of the microstrip antenna of FIG. 1.

Referring only to FIG. 2, the etched metal layer 13 forming antenna element 12 has a disk shape. Line feeds 38 electrically connect metal layer 13 with a coaxial cable connector (not shown) on the bottom of the microstrip antenna 10 that in turn is used for connecting the microstrip antenna to either a receiver or transmitter via a coaxial cable. The illustrated multi-layer microstrip antenna has two cardinal or principal axes 40 and two intercardinal axes 42. Both bore holes 30 and 32 are drilled on an intercardinal axis rather than a principal axis. A half-circular shaped piece of metal can be seen to have been removed from the perimeter of metal layer 13 by the drilling operation that formed bore hole 30.

Figure 3:
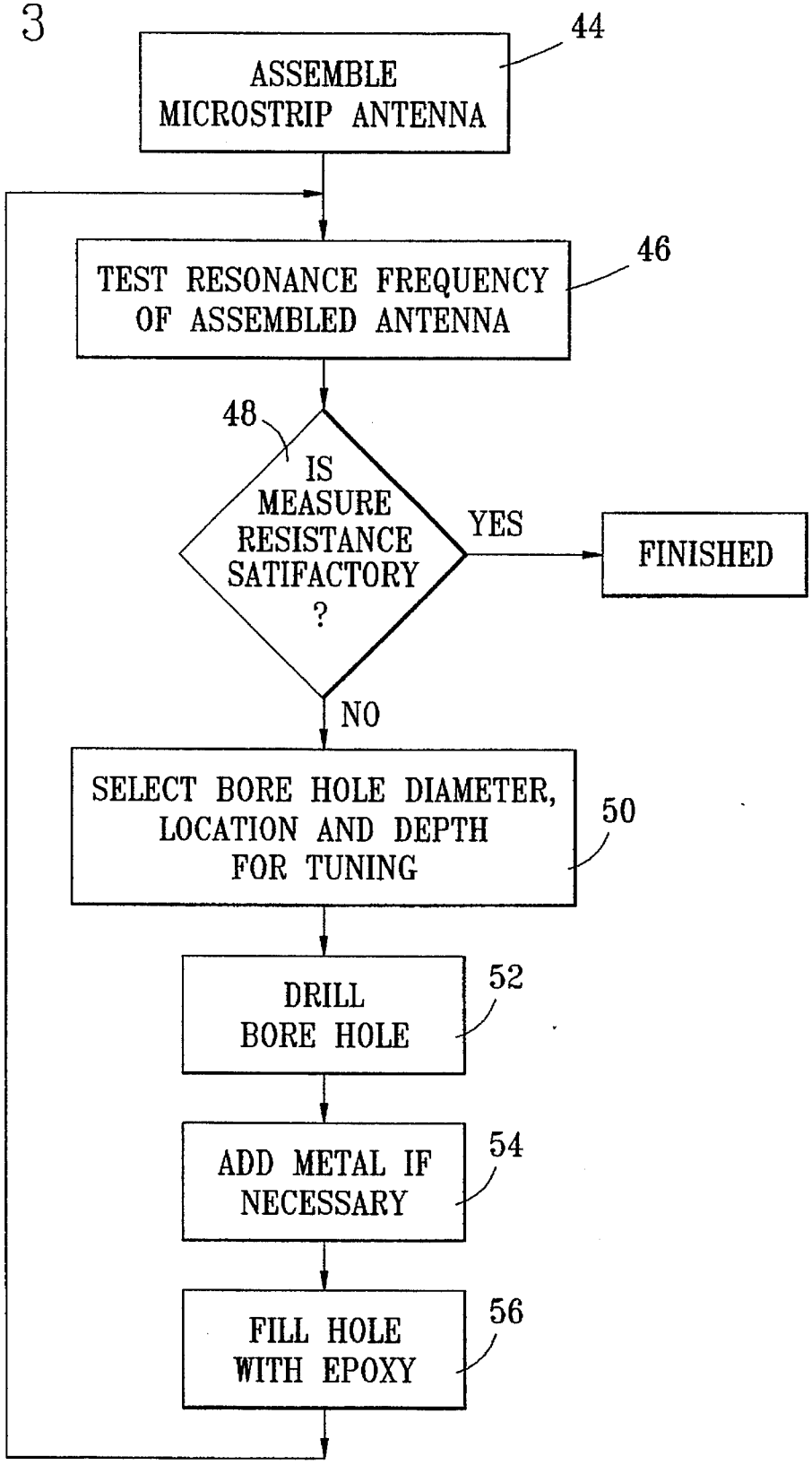
FIG. 3 is a flow chart illustrating the steps of a process for tuning a radiator of a preassembled microstrip antenna.

Referring now to FIG. 3, illustrated by a flow chart is a process for tuning the resonance frequency of a radiating antenna element of an assembled microstrip antenna. In describing the process, reference made to the assembled multi-layer microstrip antenna 10 of FIGS. 1 and 2 for purposes of illustration only. The process may be employed with microstrip antennas of any number of layers and design. At step 44, the microstrip antenna is assembled without tuning. The resonance frequency of an antenna element in the assembled microstrip antenna is measured at step 46 using conventional techniques. If, as indicated by decision 48, the measured resonance frequency is within a predetermined range of operating frequencies, tuning is not necessary or is finished. If, however, it is not within the range, then it is tuned by drilling a bore hole.

At step 50 the location and diameter of a bore hole is chosen based on the frequency shift required and the design of the antenna. Generally, care must be taken not to interfere with the polarization and coupling of the antenna element to other antenna elements. A bore hole should be drilled on an intercardinal rather than a principal axis. The bore hole is then drilled at step 52 from the outer surface of the radome layer 24. In the case of antenna element 12, its resonance frequency has been shifted higher by drilling bore hole 30 through metal layer 13 at its perimeter, thereby removing a semi-circular piece of metal from the antenna element. In the case of antenna element 14, its resonance frequency is shifted lower by drilling to the metal layer and, as indicated by optional step 54, bonding additional metal 36 to the metal layer 15. Bore holes 30 and 32 are then filled in step 56 with a non-conductive epoxy having a dielectric constant substantially similar to that of the dielectric substrates. Additional holes may be drilled as required to tune each element of the antenna.

Multi-layer microstrip antenna 10 is intended to be merely a representative example of microstrip antennas generally. Microstrip antennas tuned according to the method of FIG. 3 may have one layer or more than two layers and are not limited to any particular size, shape or radiation pattern.

The forgoing description is only of a preferred embodiment of the invention. Modifications, additions, omissions and other changes can be made to the disclosed embodiments without departing from the spirit and scope of the invention as it is set forth in the appended claims.

What is claimed is:

1. A method of tuning an assembled microstrip antenna comprising the steps of:

measuring the resonance frequency of the assembled microstrip antenna, the antenna including a substrate layer, a metal layer on the substrate for forming a first antenna element, and a dielectric layer over the metal layer;

drilling a bore hole through the dielectric layer to the metal layer at a predetermined location for accessing the metal layer and, if the measured resonance frequency is lower than a desired resonance frequency, drilling through the metal layer to remove a predetermined amount of metal tending to shift higher the resonance frequency of the antenna element; and filling the hole with a non-conductive substance having a dielectric constant approximately equal to that of the substrate.

2. The method of claim 1 further including the step of bonding additional metal to the metal layer through the bore hole if the measured resonance frequency of the antenna element is higher than the desired resonance frequency.

3. The method of claim 1 wherein the hole is drilled on an intercardinal axis of a radiation pattern of the microstrip antenna.

4. The method of claim 1 wherein the non-conductive substance is an epoxy.

5. The method of claim 1 wherein the assembled microstrip antenna includes a second antenna element layered with the first antenna element.

6. A microstrip antenna tuned to a desired resonance frequency comprising:

a first layer of dielectric material having top and bottom surfaces;

a first antenna element formed from a layer of metal on the top surface and having a predetermined antenna pattern and resonance frequency;

a second layer of dielectric material overlaying the first antenna element and bonded to the first layer;

a bore hole formed by drilling downwardly from the top surface of the second layer and through the metal layer for removing a portion of the predetermined antenna pattern and raising a resonance frequency of the antenna element; and a non-conductive dielectric material filling the bore hole.

7. The microstrip antenna of claim 6 wherein the hole is drilled on an intercardinal axis of a radiation pattern of the microstrip antenna.

8. The microstrip antenna of claim 6 wherein the non-conductive, dielectric material filling the bore hole is an epoxy.

9. The microstrip antenna of claim 6 further comprising a second antenna element layered with the first antenna element.

10. The microstrip antenna of claim 6 wherein the bore hole is located substantially along an outer perimeter of the metal layer forming the first antenna element.

11. A microstrip antenna tuned to a desired resonance frequency comprising:

a first layer of dielectric material having top and bottom surfaces;

a first antenna element formed from a layer of metal on the top surface according to a predetermined pattern and having a resonance frequency;

a second layer of dielectric material overlaying the antenna element and bonded to the first layer;

a bore hole formed by drilling downwardly from a top surface of the second layer of dielectric material to the metal layer;

additional metal in the bore hole bonded to the metal layer for decreasing the resonance frequency of the antenna element; and a non-conductive dielectric material filling the bore hole.

12. The microstrip antenna of claim 11 wherein the hole is drilled on an intercardinal axis of a radiation pattern of the microstrip antenna.

13. The microstrip antenna of claim 11 wherein the non-conductive, dielectric material filling the bore hole is an epoxy.

14. The microstrip antenna of claim 11 further comprising a second antenna element layered with the first antenna element.

15. The microstrip antenna of claim 11 wherein the bore hole is located substantial at an outer perimeter of the metal layer forming the first antenna element.

* * * * *